United States Patent [19]

Marshall

[11] Patent Number: 4,858,509

[45] **Date of Patent: * Aug. 22, 1989**

[54] ELECTRIC MUSICAL STRING INSTRUMENTS

[76] Inventor: Steven C. Marshall, 5 Ice Pond Ct., Baltimore, Md. 21208

[ * ] Notice: The portion of the term of this patent subsequent to Jun. 7, 2005 has been disclaimed.

[21] Appl. No.: 200,696

[22] Filed: May 31, 1988

Related U.S. Application Data

[62] Division of Ser. No. 903,266, Sep. 3, 1986, Pat. No. 4,748,887.

[51] Int. Cl.[4] ..... G10H 1/18; G10H 1/34

[52] U.S. Cl. ..... 84/1.16; 84/DIG. 30

[58] Field of Search ..... 84/1.15, 1.16, DIG. 30

[56] References Cited

U.S. PATENT DOCUMENTS

| | | | |
|---|---|---|---|
| 3,217,079 | 11/1965 | Murrell | 84/DIG. 30 |
| 3,482,029 | 12/1969 | Sines | 84/1.16 |
| 3,530,227 | 9/1970 | Wheeler et al. | 84/DIG. 30 |
| 3,699,492 | 10/1972 | Yoshihara | 84/DIG. 7 |
| 3,786,167 | 1/1974 | Borell et al. | 84/DIG. 30 |
| 4,235,141 | 11/1980 | Eventoff | 84/1.16 X |
| 4,321,852 | 3/1982 | Young, Jr. | 84/1.16 |
| 4,372,187 | 2/1983 | Berg | 84/DIG. 30 |
| 4,430,918 | 2/1984 | Meno | 84/1.16 |
| 4,468,997 | 9/1984 | Young, Jr. | 84/DIG. 30 |
| 4,630,520 | 12/1986 | Bonanno | 84/1.16 |
| 4,635,518 | 1/1987 | Meno | 84/1.16 |
| 4,653,376 | 3/1987 | Allured et al. | 84/1.16 |

FOREIGN PATENT DOCUMENTS 2178217A 2/1987 United Kingdom .

*Primary Examiner*—Stanley J. Witkowski
*Attorney, Agent, or Firm*—Edward D. C. Bartlett

[57] ABSTRACT

An electric musical string instrument, particularly an electric guitar, has a body structure carrying fret assemblies and at least one string extending lengthwise over the fret assemblies. Each fret assembly includes at least one resistive element which is associated with a string contact surface of that fret assembly. The effective resistance of the resistive element changes in dependence upon transverse deflection of the string, when in contact with the string contact surface, to effect bending of the note being played. Preferably the string contact surface is formed by the resistive element.

17 Claims, 7 Drawing Sheets

FIG. 3
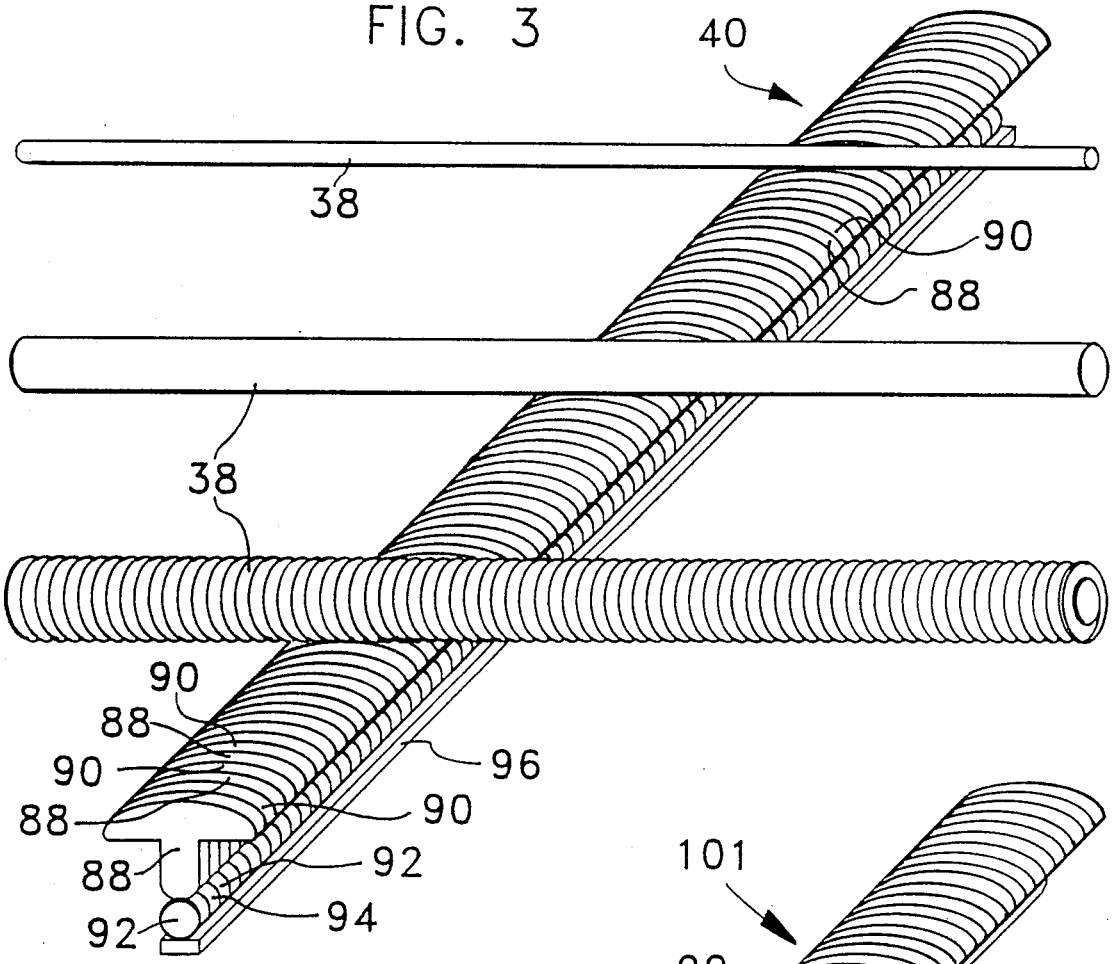
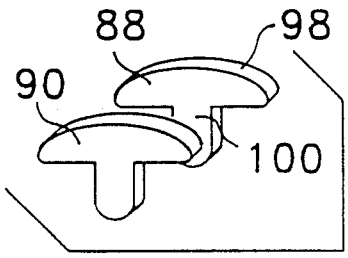
FIG. 4
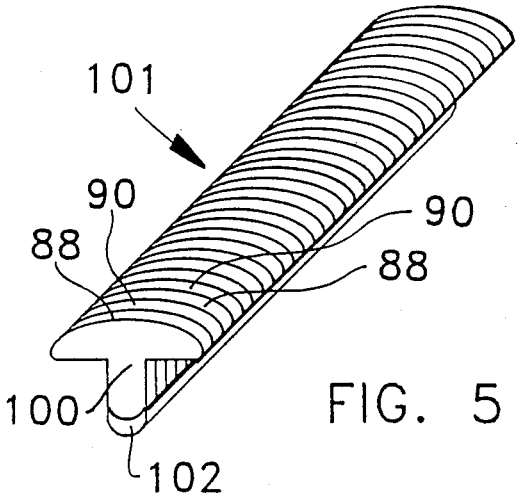
FIG. 5

FIG. 10
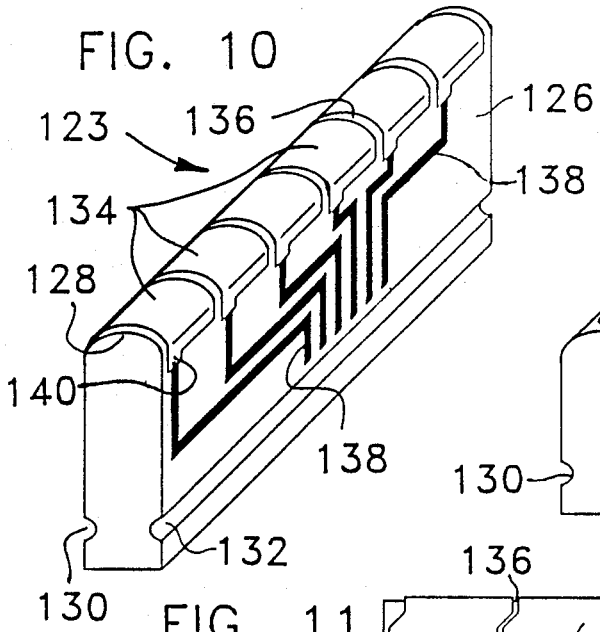
FIG. 12
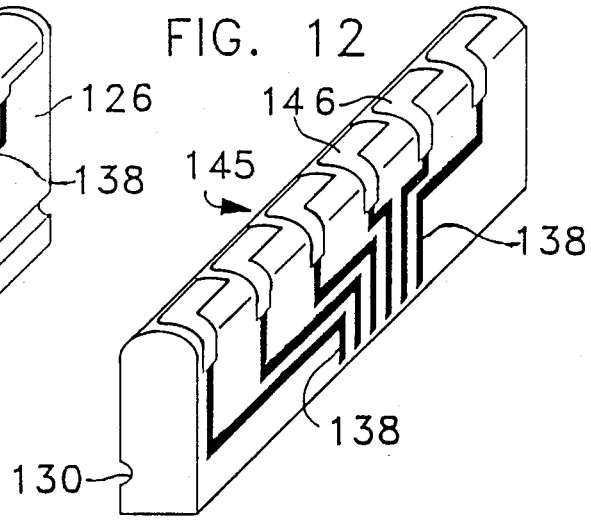
FIG. 11
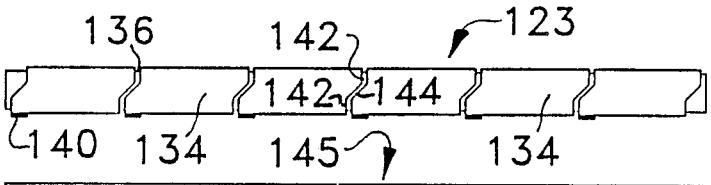
FIG. 13
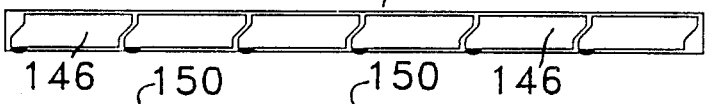
FIG. 14
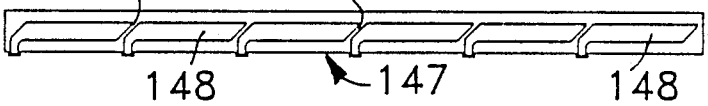
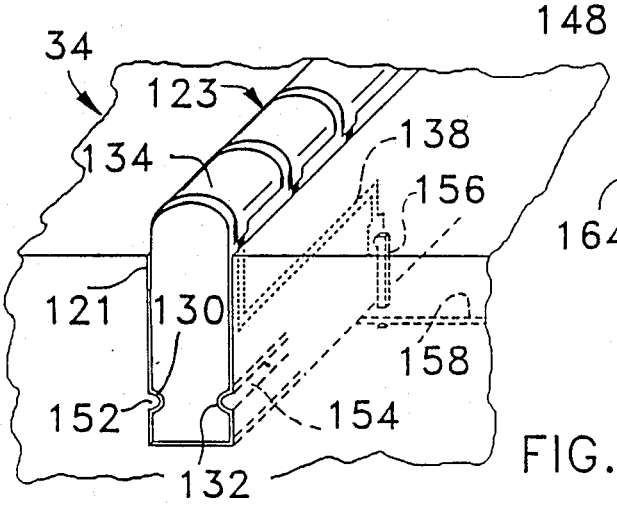
FIG. 15
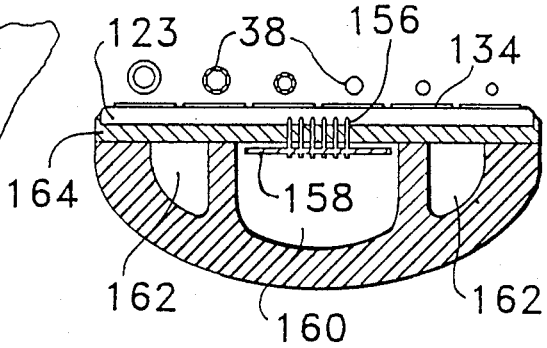
FIG. 16

ELECTRIC MUSICAL STRING INSTRUMENTS

This is a division of application Ser. No. 903,266, filed Sept. 3, 1986 and now U.S. Pat. No. 4,748,887.

FIELD OF THE INVENTION

This invention relates generally to electric musical string instruments, particularly electric guitars, both in the form of sound producing instruments and controllers. This invention also relates to frets for such instruments.

BACKGROUND OF THE INVENTION

There are at present two systems for electric guitars using guitar to synthesizer or guitar to MIDI controllers (MIDI meaning musical instrument digital interface). Both these systems have problems relating to playing technique. These problems are so serious that experienced electric and non-electric guitar players find them a major obstacle to overcome in order to get satisfactory playing results on either system alone. Such guitar players have to actually unlearn their normal guitar playing style and relearn a special playing technique for each system.

The first and oldest of these systems has six playing strings scanned or wired together at one end to form, in effect, one contact of a switch. Each fret, over which the strings pass, is divided into six segments which are electrically insulated and function as six switch contacts, one switch contact for each string. There are up to twenty-four such frets along the neck of the guitar providing one hundred and forty four string/fret intersections or switches. A set of two string/fret switches are closed when a selected string is pressed by a finger of the left hand of the guitar player between the respective segments of the selected adjacent frets. The selected fret nearer the bridge of the guitar determines the note being played. This first system has a number of problems.

Firstly, the segmented fret assemblies require six electrical wires for each fret. With twenty-four frets, a total of one hundred and forty-four wires are required for the neck wiring harness. This harness is difficult to manufacture; further, these wires and fret connections are virtually unrepairable once assembled inside the guitar neck. Thus, it is virtually impossible to replace a worn fret without replacing the whole wiring harness and all the frets.

Secondly, as these fret segments are simple logic switches, notes played on this system cannot be "bent" or drifted, a musical effect that electric guitar players consider to be essential. It is generally agreed that note bending is one of the most important characteristics that make the guitar unique and identifiable in popular music.

Thirdly, with the more basic versions of this system there is no possibility of other player expression such as use of the pick. As soon as a string touches a fret a note begins, ignoring completely whatever the guitar player's right hand may be doing. This also applies to right hand pick expression or "velocity" since all picking functions are totally ignored, this first system being unable to respond to use of the pick by the guitar player.

The second system has a magnetic pick-up head mounted near the bridge over which the six strings are tensioned and supported. This pick-up head feeds a pitch follower circuit of some sort, such as a pitch to voltage or pitch to MIDI arrangement. There are several main problems with this second system.

Firstly, it takes too long to determine the pitch of each note being played. The laws of physics dictate the maximum speed with which this can be done. A minimum of two valid samples, spaced apart in time of the lowest frequency component of each note has to be obtained in order to define a note. Even if all operation headroom time is removed, the act of pitch determination alone takes so long that almost all guitar players find it too slow.

Secondly, each note on each string has an entirely different harmonic structure. This harmonic structure also changes radically for any note as a function of how hard the note is picked, where on the string it is picked, what note was previously picked on that string, and what other notes are ringing on other strings. Further, the harmonic structure also changes radically for any note as a function of the time that note is held. In addition, the dominant frequency component of a guitar note is almost never the desired lowest frequency, but the second harmonic above it, i.e. the harmonic above the fundamental harmonic. This dominant component also changes as the note decays. This tends to make the pitch follower or pitch detection systems unstable and unreliable; they not infrequently find the wrong note, or jump to wrong notes as the actual notes decay. This necessitates very careful and deliberate playing technique to get even minimal results. This again means that the musician must unlearn his style and relearn a special cautious playing technique if he wishes to control a synthesizer via the guitar.

Thirdly, a great deal of circuitry such as tracking filters, automatic gain compensators, limiters, gain control stages and precision rectifiers are required for each string, making production of this circuitry expensive and physically too large to fit into the guitar body itself. Typically massive, and more unreliable, connection cables are required between the guitar controller itself and the rest of the system support circuitry.

Further, arbitrary decisions must be made using amplitude sensing in determining when a note is "on", and then "off". If the note on threshold is too high, some or even many notes are missed. On the other hand, if the "note on" threshold is too low, false notes and various noises appear as artifacts of normal playing. Since playing style may vary even during one song, and this threshold is set throughout the song, this presents a problem second only to pitch detection lag and errors.

Thus, both these current electric guitar systems have different problems that restrict the playing ability and performance of accomplished guitarists.

SUMMARY OF THE INVENTION

The present invention is concerned with mitigating the above problems and providing systems that give musicians more freedom of playing expression.

Among other things, the invention is concerned with enabling notes to be "bent", particularly in accordance with the normal playing style of a guitarist in "bending" a note. A feature by which this is achieved is the incorporation of one or more resistive elements in the fret assemblies such that transverse deflection of a string while in contact with the fret assembly will change the effective resistance value thereof.

Another feature of the invention is providing a system whereby only one conductor need be employed per fret assembly, thus enabling the above mentioned 144 wire harness to be reduced to 24 wires in a 24 fret guitar. A further feature of the invention is scanning the strings and separately scanning the fret assemblies, preferably at different rates which, in conjunction with the above resistive fret assemblies, enables complete logical determination of any note being attempted by the musician.

A feature of a preferred embodiment of the invention is the incorporation of a printed circuit board in the neck of a guitar to electrically connect the fret assemblies to the body portion of the guitar. This has the advantage of enabling individual fret assemblies to be readily replaced, and also reduces the assembly cost of the instrument.

Another feature of the preferred embodiment of the invention is the employment of at least one audio pickup, in conjunction with MIDI controller features of the instrument, to enable "picking" expression and velocity to be obtained while using a MIDI synthesizer.

According to one aspect of the invention, there is provided an electric guitar comprising a body structure carrying fret assemblies and strings extending lengthwise over the fret assemblies, each fret assembly including means comprising at least one resistive element forming part of that fret assembly and being associated with a string contact surface of that fret assembly for enabling the effective resistance of the element to change in dependence upon transverse deflection of a string when in contact with the surface for enabling note bending to be achieved, each fret assembly having a lengthwise direction extending transversely to the strings, and the resistive element extending the length of its respective fret assembly in the lengthwise direction of that fret assembly.

According to another aspect of the invention, there is provided an electric guitar comprising a body structure carrying fret assemblies and strings extending lengthwise over the fret assemblies, each fret assembly including means comprising at least one resistive element forming part of that fret assembly and being associated with a string contact surface of that fret assembly for enabling the effective resistance of the element to change in dependence upon transverse deflection of a string when in contact with said surface for enabling note bending to be achieved, and the resistive element comprising a resistive pad forming at least part of the string contact surface of the respective fret assembly.

According to a further aspect of the invention, there is provided an electric musical instrument comprising a body structure carrying a plurality of discrete fret assemblies and at least one string extending over the fret assemblies, the fret assemblies being elongate and extending in lengthwise direction transversely to the string, the fret assemblies being physically spaced apart along the string, each fret assembly including its own separate resistor contactable by the string when brought into contact with the respective fret assembly, means for completing an electric circuit comprising at least portions of the string and the respective resistor when the latter is contacted by the string, the resistance of the respective resistor in the circuit varying in dependence on the location on the respective resistor at which the string contacts that resistor, and means associated with the electric circuit completing means for determining the note being played and for enabling bending of that note responsive to changes in the resistance of the respective resistor, contact between the string and a respective fret assembly establishing the note being played and transverse deflection of the string on this fret assembly in the lengthwise direction of the latter effecting bending of this note.

Each resistor may form an upper surface of the respective fret assembly below the string. Each resistor may comprise a resistive pad. This pad may be formed by a coating on a body member of the fret assembly, the coating having a discrete thickness.

Each resistor may be elongate and extend lengthwise in the lengthwise direction of the respective fret assembly.

According to yet a further aspect of the present invention, there is provided an electric musical instrument comprising a body structure, at least one electrically conductive string connected to the body structure, a plurality of frets supported by the body structure with the string extending over the frets, each fret having a surface contactable by the string when depressed thereagainst, this surface protruding above a surrounding surface area of the body structure, at least a portion of the protruding fret surface being formed by a resistive element, means for completing an electric circuit through the string and any fret when the string is brought into contact with the resistive element of the respective fret and for determining a musical note to be played by such contact, the electrical resistance of the resistive element in said circuit varying in accordance with transverse deflection of the string on and in contact with the resistive element, and means responsive to the varying of the electrical resistance for causing variation in a parameter of the musical note being played on the musical instrument.

The parameter is preferably the pitch of the note being played and transverse deflection of the string while in contact with said resistive element preferably effects bending of the note being played.

According to yet another aspect of the invention, there provided an electric guitar comprising a body structure carrying a plurality of spaced apart frets, at least one string carried by the body structure and extending in a lengthwise direction over and out of contact with the frets, the frets extending parallel to each other in a direction transverse to the lengthwise direction of the string, each fret having a string contact surface which is contacted by the string when depressed against the respective fret to determine the musical note to be played, each contact surface being formed by a resistive element which extends in the direction transverse to the lengthwise direction of the string, and means for completing an electric circuit through at least portions of the string and the respective resistive element of one of the frets when the string is depressed thereagainst, the effective resistance of the respective resistive element in the electric circuit changing in dependence upon transverse deflection of the string when in contact with the respective resistive element for enabling note bending to be achieved.

Other objects, features and advantages of the present invention will become more fully apparent from the following detailed description of the preferred embodiments, the appended claims and the accompanying drawings.

BRIEF DESCRIPTION OF THE DRAWINGS

In the accompanying drawings:

FIG. 3 is a perspective view, on a larger scale, of a portion of a of a fret arrangement according to the invention below three of the strings of the guitar of FIG. 1;

FIG. 4 is an exploded perspective view of two segments of the fret arrangement of FIG. 3;

FIG. 5 is a perspective view of a modified fret arrangement according to the invention;

FIG. 10 is a perspective view of a fourth embodiment of a fret according to the invention;

FIG. 11 is a top plan view of the fret of FIG. 10;

FIG. 12 is a perspective view of a modification of the fret of FIG. 10;

FIG. 13 is a top plan view of the modified fret of FIG. 12;

FIG. 14 is a top plan view of a further modification of the fret of FIG. 13;

FIG. 15 is a fragmentary perspective view illustrating the mounting and one of the electric connections of the fret of FIG. 10, 12, or 14 in the neck of the guitar of FIG. 1, the neck being further modified according to the invention;

FIG. 16 is a section similar to FIG. 8 but illustrating the fret of FIG. 10, 12, or 14 mounted in the modified guitar neck of FIG. 15;

DETAILED DESCRIPTION OF THE PREFERRED EMBODIMENTS

Figure 1:
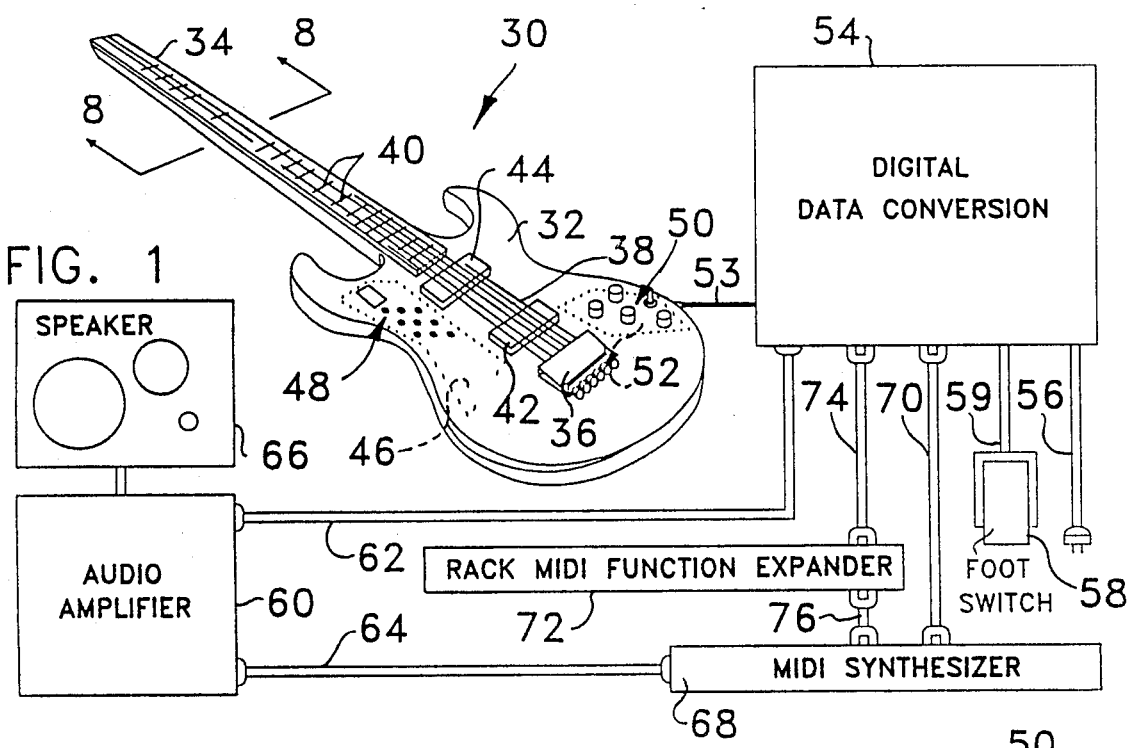
FIG. 1 diagrammatically illustrates an electric string instrument system according to the invention, with the string instrument being a guitar shown in a simplified perspective view.
Figure 20:
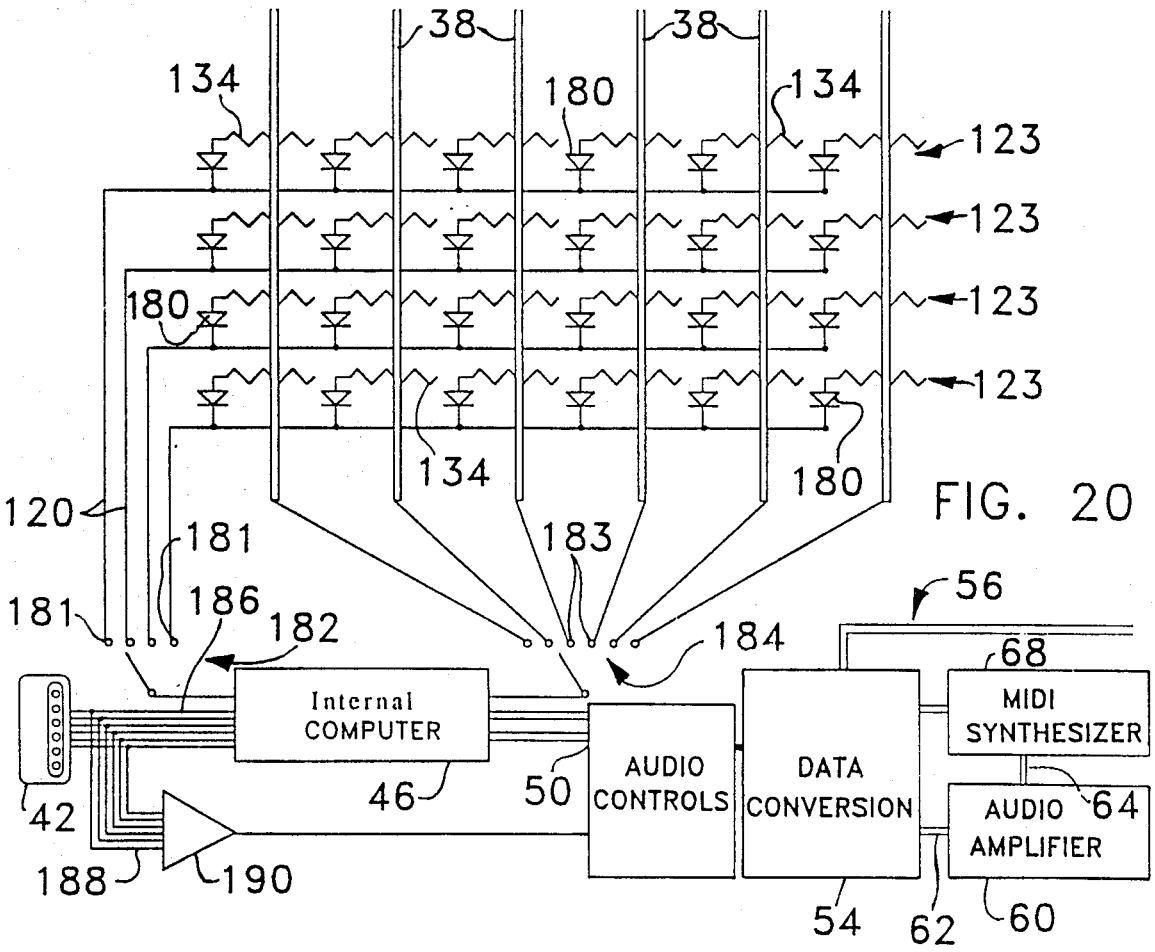
FIG. 20 is a simplified circuit diagram, partly in block form, of the system of FIG. 1 and illustrating the string/fret intersections when employing the frets of FIGS. 10, 12 or 14.

The preferred electric musical string instrument system of the invention can most readily be understood from FIGS. 1 and 20, and the preferred fret arrangements of the invention are illustrated in FIGS. 3 through 16 with the fret of FIGS. 12 and 14 being most preferred.

FIG. 1 illustrates an electric guitar 30, which functions either as a MIDI guitar controller or an audio guitar, having a body portion 32 from which extends forwardly a neck portion 34. A bridge 36 is mounted on the guitar body towards a rear end thereof, and six electrically conductive strings 38 extend from the bridge 36 to the forward end of the neck 34, the strings passing over and being spaced above twenty-four frets 40 mounted in the neck 34. Two hex magnetic pickup heads 42 and 44 are spaced apart between the bridge 36 and the neck 34, and are disposed below the strings 38, each hex pickup 42, 44 having a separate magnetic head for each string. A computer unit 46 (shown in broken lines) is disposed inside the guitar body 32 to one side of the location of the strings. An input keyboard 48 is accessibly mounted on the guitar body for manual entry of input data to the computer unit 46. On the opposite side of the strings, four control knobs 50 are provided for controlling circuitry 52 associated therewith which is also housed within the guitar body 32.

The guitar 30 is connected to a floor unit 54 through an interface cable 53. A power cable 56 connects the floor unit 54 to a source of electrical power supply, e.g. one hundred and ten volt AC, which is rectified in the unit 54 and 5 volt DC supplied through the cable 53 to the circuitry in the guitar 30. A foot switch 58 is connected to the unit 54 via a cable 59. An audio amplifier unit 60 is connected via a cable 62 to an audio output of the unit 54. The output from the amplifier 60 is connected via cable to a speaker 66; if the system were designed to provide stereo sound, then two such speakers would be connected to the amplifier 60. The amplifier unit 60 is also connected via cable 64 to a MIDI synthesizer unit 68 which is connected directly via a cable 70 to a MIDI output of the floor unit 54 and, or preferably alternatively, via cables 74 and 76 through a rack MIDI function expander unit 72 to another MIDI output of the unit 54. The MIDI function expander can be used to provide extra functions, for example sequencing (repeat what has been played) and MIDI mapping such as turning on vibrato. Also, this unit 72 can be employed to control a multiplicity of synthesizers, e.g. one for left hand play and another for right hand play.

The guitar 30 can be used to supply the amplifier 60 with direct audio output via the cable 62, or can be used as a MIDI guitar controller to provide synthesized MIDI output to the amplifier 60 via the cable 64. Also, the guitar 30 can be used to simultaneously provide the amplifier 60 with direct audio output via cable 62 and synthesized MIDI via cable 64.

The floor unit 54 provides the power for the system and includes a controller interface, digital data conversion, conventional audio extraction, a foot switch interface, and a MIDI interface. The MIDI synthesizer 68 may be a conventional unit and function in a manner which is well known to those skilled in MIDI synthesizers.

Figure 2:
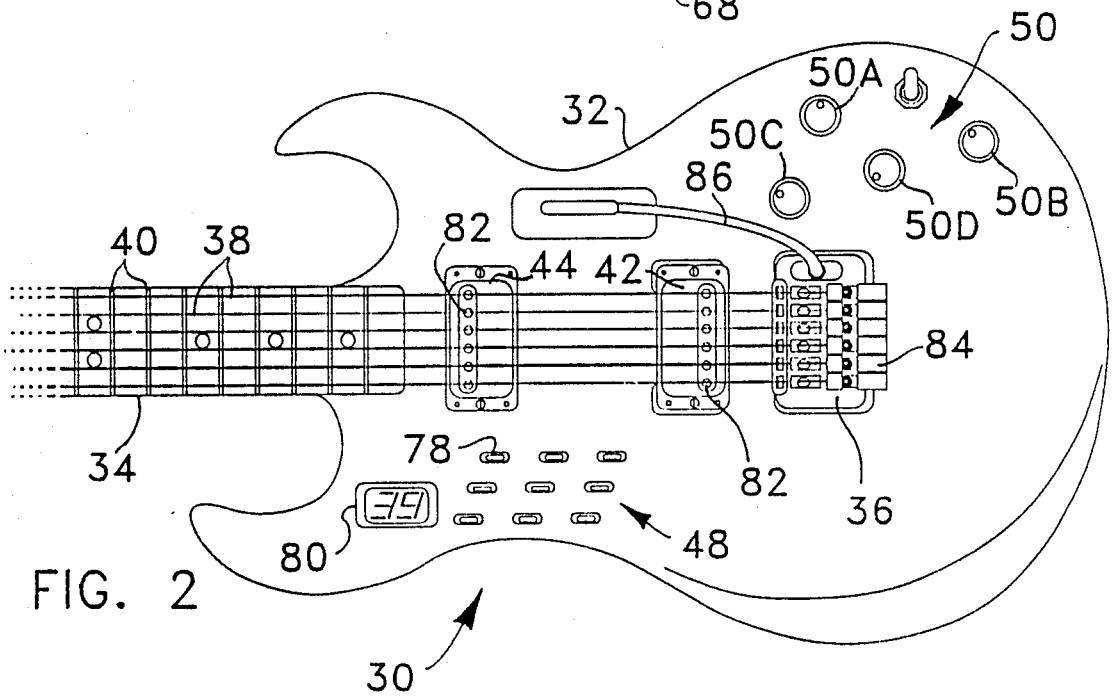
FIG. 2 is a top plan view of the guitar of FIG. 1 showing more detail, but with most of the neck of the guitar omitted for simplicity.

FIG. 2 is a plan view of the guitar body 32 and part of the neck 34. Entry keys 78 of the input keyboard 48 can be seen more clearly, these keys functioning as digital interface controls to enable modified and/or the usual "string" signals to be produced. The keyboard 48 is also provided with two visual displays 80 for providing information relating to the setting of the keys 78. The six individual magnetic heads 82 on each of the hex pickups 42, 44 can be seen. The bridge 36 is provided with six string tension adjusters 84, one for each string. The control knobs 50 comprise a volume control 50*a*, a tone control 50*b*, and two "soft" optionally programmable controls 50*c* and 50*d*. Functions for the soft controls 50*c*, 50*d* are programmed through the keyboard 48. A manually operable vibrato bar 82 is associated with the bridge 36; in addition to its conventional function of providing vibrato by oscillating the bridge 36 when the bar is manually oscillated, movement of the bar 86 can be used to provide other effects by entering alternative programming commands through the keyboard 48, e.g. volume control. The two hex pickups 42, 44 are included to provide the guitar with greater versatility and also to enable it to be used to provide "string" sound outputs. However, to enable the guitar system to be sensitive to righthand picking, and also to allow a full range of picking expression, only one of the hex pickups 42, 44 is necessary. Preferably, if only one hex pickup is employed, then this would be incorporated in the bridge 36 (possibly as a laser or piezoelectric pickup to reduce the space required).

FIG. 3 shows a perspective view of part of the length of one of the frets 40, with three of the strings 38 being diagrammatically shown extending over and above this portion of the fret 40. The upper part of the fret 40 is made up of a sandwich comprising a multiplicity of alternating slice-like segments 88 and 90. The segments 88 are made of electrical conducting material, e.g. metal, or conductive ceramic compounds, and the similarly shaped slice-like segments 90 are made of electrically insulating material, e.g. non-conductive ceramic, glass, non-conductive plastic, or simply epoxy resin binding the alternate segments 88 and 90 together. The bottom of each segment 88, 90 is in firm contact with a small disk 92, 94 of the same thickness as each of the segments 88, 90. The disks 92 are made of electrically conducting material e.g. conductive silicone rubber (as used with liquid crystal displays), and the alternating disks 94 are made of electrically insulating material, e.g. non-conductive silicone rubber. The disks 92, 94 are compressed against a linear resistive element 96, in the form of a thin strip forming the bottom of the fret 40, when the fret 40 is inserted as a press fit in a slot in the neck of the guitar. As can more clearly be seen in FIG. 4, the segments 88 and 90 are identical in shape and size, each being of somewhat T-shape with a convex upper surface on the top of the T, and a downwardly extending central stem 100 having a convexly curved lower surface. Thus, each contacting segment 88 and the conducting disk 92 it contacts form a conducting path having no resistance to a specific linear location on the resistive element 96. Also, adjacent conducting paths 88, 92 are separated by an insulator comprising one of the insulating segments 90 and its associated insulating disk 94. A wire lead, or similar electrical conductor, is connected to one end of the conductive element 96 (see FIG. 8). Consequently, when one of the strings 38 is pressed against the upper convex surface of the fret 40, the length of the resistive path, and so the resistance, from the depressed string 38 to the connected end of the fret 40 will depend upon the exact location along the length of the fret 40 (i.e. in a direction at right angles to the strings 38) at which the string is depressed against the fret 40. In particular, it should be noted that as a string is deviated sideways when in contact with the fret 40 (i.e. moved in the lengthwise direction of the fret) the deviated string will move into contact with successive conducting segments 88 so changing the resistive value of the position of the element 96 in the path between the string and the connected end of the fret. The segments 88, 90 are each relatively thin in comparison with the diameter of the strings and are preferably not thicker than the thinnest string, as can be seen in FIG. 3; preferably, there are 50 conducting segments 88 per inch length of the fret 40, i.e. each segment 88 has a thickness of 0.010 inches. Each of the frets 40 is let into a respective transverse slot in the neck of the guitar with the convex surfaces of the segments 88, 90 protruding above the upper surface of the guitar neck.

When the disks 92, 94 have the same thickness as the segments 88, 90 then the disks 92, 94 are carefully aligned with the segments 88, 90, respectively. However, preferably the disks 92, 94 are one half or less than the thickness of the segments 88, 94 so eliminating any need for such alignment and simplifying assembly.

FIG. 5 shows a modification of the fret of FIGS. 3 and 4. The modified fret 101 is made up of the same assembly of alternating conductive and insulating slice-like segments 88, 90. However, the disks 92, 94 and the resistive strip-like element 96 of FIG. 3 are replaced by a layer 102 of resistive plastic which is adhered to and along the lower curved ends of the stems 100 of the segments 88 and 90. Resistive plastic is well known, and a formulation is chosen so that the layer 102 has an appropriate linear resistance along its length. With this modified fret 102 it is preferable, when each fret 101 is disposed in the appropriate slot in the guitar neck, to ensure there is a clearance between the resistive plastic layer 102 and the bottom of the neck slot to avoid variable pressure on the layer 102 which could change its resistive value. Again, a conducting wire or element is connected to one end of the resistive layer 102.

Figure 6:
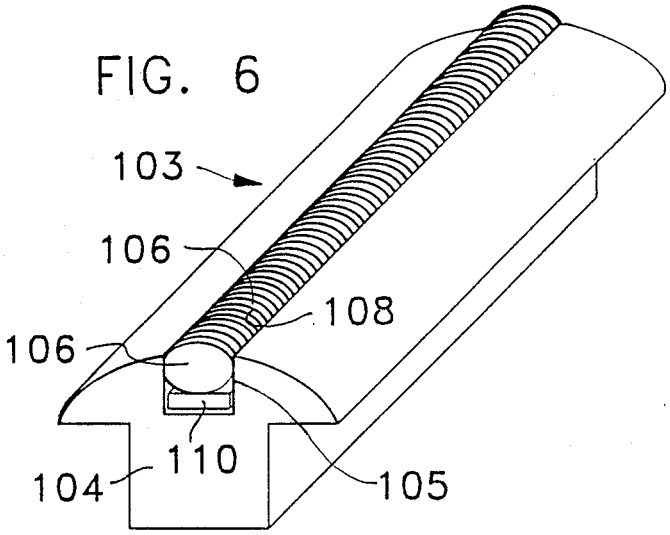
FIG. 6 is a perspective view of yet another modified fret arrangement according to the invention.

FIG. 6 shows a further modified fret 103 which functions in the same way as frets 40 and 101, but is differently constructed. The fret 103 has a main body part 104 of insulating material (e.g. plastic or ceramic) and of general T-shaped cross section with a convexly curved upper surface. A central channel 105 is formed in the upper convexly curved surface along the length of the fret. A linearly resistive strip-like element 110 (similar to the element 96 in FIG. 3) is disposed along the bottom of the channel 105. A multiplicity of alternating conductive disks 106 and insulating disks 108 are secured on top of the element 110 with a portion of each disk 106, 108 protruding above the convex upper surface of the fret body 14. Each fret body 104 is inserted in a transverse slot in the guitar neck, and a conducting wire or element connected to one end of the resistive element 110. This fret functions the same as frets 40 and 101, except if desired the disks 106 and 108 can more readily be made even thinner for greater sensitivity of string deviation when in contact with the fret.

Figure 7:
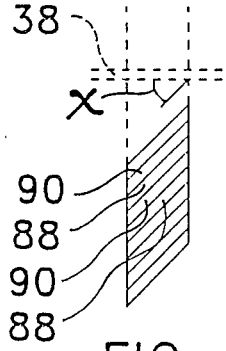
FIG. 7 illustrates in a fragmentary top plan view a further modification according to the invention of the frets of FIGS. 3, 5 and 6.

FIG. 7 illustrates a modification which is applicable to any of the frets 40, 101, or 103. FIG. 7 shows a plan view looking downwardly on a portion of the length of the top of the fret. The alternating disks 80, 90 of the embodiments of FIGS. 3 and 5 are arranged at an acute angle x to the direction of the strings, one string 38 being indicated in broken lines. Angle x is preferably 45 degrees, but may be in the range of 15 to 75 degrees. The alternating disks 106, 108 in the embodiment of FIG. 6 can similarly be so arranged. This skewing or oblique arrangement of the alternating conducting and insulating slices has the advantages of decreasing or eliminating the percentage of a string only contacting an insulating segment (even if only for a split second), reduces any feeling of the string passing over the segments, and substantially eliminates any chance of a string catching an edge of a segment and damaging the latter. These advantages are particularly applicable when "bending" a note.

Figure 8:
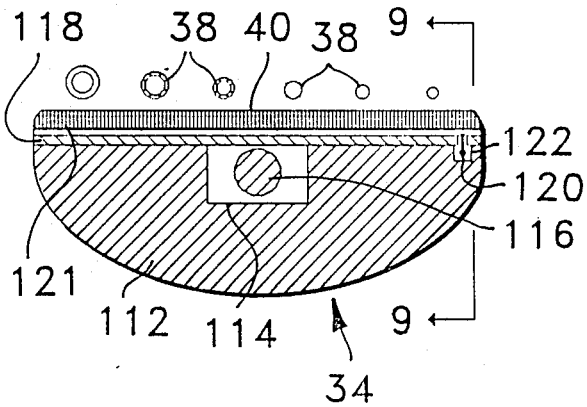
FIG. 8 is a section on the line 8—8 of FIG. 1 showing a fret according to FIGS. 3, 5 or 6.
Figure 9:
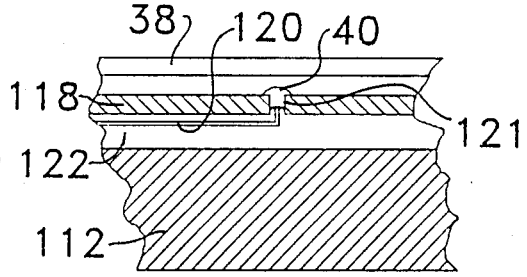
FIG. 9 is a fragmentary section on the line 9—9 of FIG. 8.

FIG. 8 is a cross section through the neck of the guitar on the line 8—8 of FIG. 1. The main solid body portion 112 of the neck 34 has an upper longitudinal rectangular cavity 114 through which extends a steel reinforcing rod 116. The upper surface of the body portion 112 and the top of the cavity 114 are covered by a finger plate 118. The frets 40 are pressed downwardly into transverse slots 121 in the finger plate 118, which is made of electrically insulating material, preferably as a light press fit, and may also be adhered in place by adhesive, e.g. cyanoacrylite, which can be chipped out to replace a fret. The location of the strings 38 above the fret can be clearly seen. At the righthand end of each fret 40, i.e. the high string end, a conducting wire 120 passes downward through a hole in the finger plate 118 into a small channel 122 which runs along the length of the neck 34 adjacent the righthand side thereof. The upper end of each wire 120 is connected to an end of the linear resistive element 96 of the respective fret 40. The frets of FIGS. 5 and 6 are similarly mounted and connected in the neck of the guitar. With twenty-four frets in the neck of the guitar, at the guitar body end of the channel 120, the channel will contain twenty-four wires 120. FIG. 9 is a fragmentary section on the line 9—9 of FIG. 8, and shows a fret 40 inserted in the transverse slot 124 with the wire 120 extending through the channel 122 from the fret towards the guitar body.

FIG. 10 shows a perspective view of a further embodiment of a fret according to the invention. This fret 123 has an elongate body 124 made of electrically insulating material, preferably ceramic. The body 126 has a convexly curved upper surface 128. Longitudinal grooves 130, 132 extend along the length of each side of the body 126 adjacent the bottom thereof. Six resistive pads 134 are adhered over the convex upper surface 128, the six pads being spaced apart along the length of the upper surface of the fret with a small gap 136 between adjacent pads 134. Each pad 134 has at one end a downwardly extending tab 140. All the six tabs 140 are disposed on their pads 134 towards the same end of the fret. A conductive path 138 extends down one side of the body 126 from each of the tabs 140. As can be seen, each conductive path 138 first extends vertically downwards, then has a horizontal section, and then finally extends vertically downwards again and terminates just short of the groove 132. In this way, the lower ends of the six conductive paths 138 are grouped together near the center of the length of the body 126 just above the groove 132.

FIG. 11 is a top plan view of the fret 123 of FIG. 10. The tabs 144, to which the conductors 138 are electrically connected, can be seen spaced along one side of the fret. The precise form of the gaps 136 between adjacent resistive pads 134 is more clearly shown. Each gap 136 has a straight portion 142 adjacent each side of the fret and at right angles thereto. However, the straight portion 142 on one side of the fret is staggered lengthwise of the fret with respect to the straight portion 142 on the other side of the fret with these two straight portions 142 being connected by an oblique portion 144. Thus, a portion of each pad 134 overlaps in the lengthwise direction of the fret a portion of each adjacent pad 134, while still maintaining an insulating gap 136 between each pair of adjacent pads 134. This overlapping feature of the pads 134 provides the same advantages as the skewing arrangement of the slices mentioned above in relation to the arrangement in FIG. 7.

FIGS. 12 and 13 show a modification of the fret of FIGS. 10 and 11. The fret 145 of FIGS. 12 and 13 is identical to the fret 123, except that the resistive pads 146 are narrower in plan view and do not cover the entire upper convex surface widthwise of the fret. Also, the groove 132 on the conductor side of the fret is omitted allowing the conductors 138 to extend further downwardly to adjacent the bottom of the fret. So the fret 145 thus has only a single retaining groove 130 (the function of which will be explained in relation to FIG. 15) on the opposite side of the fret to the conductive paths 138. Further, this arrangement is cheaper to manufacture and provides for space for the pad connections.

FIG. 14 shows in top plan view a further preferred modification of the frets of FIGS. 10 and 12, this further modified fret 147 having even narrower striplike resistive pads 148 which cover only one half to one third of the upper convex surface of the fret. The small gaps 150 between the resistive pads 148 are formed as straight obliquely disposed gaps, preferably at 45 degrees, providing the advantages previously mentioned. With this embodiment, and also with fret 145 of FIG. 12, instead of disposing the resistive pads along the center portion of the convex upper surface 128, these pads may be shifted more towards one side of this convex surface, the side directed towards the body of the guitar. This facilitates contact between the guitar strings and these narrower resistive pads.

The pads 134, 146 and 148 of the embodiments of FIGS. 10, 12 and 14 are formed on the ceramic body 126 by baking on resistive cermet ink which has been applied by silk screening. This baked on coating is approximately 0.0005 inch thick. The conductive paths, or headers, 138 are formed of silver alloy and bonded to the resistive pads. The lower ends of these conductive paths 138 (for example see the enlarged lower end in FIG. 15) are formed as conductive polymer contact areas to reduce oxidation and are bonded to the paths 138.

Preferably the width of the pad 148 is chosen to be as narrow as possible before the meniscus effect (of the cermet ink) at the front and back edges of the pad being formed causes uneven thickness thereof with associated non-linear vertical resistive diffusion. This tends to take place with pad widths below 0.020 inch. Although a pad width of 0.025 inch would be optimum, a pad width of 0.040 inch provides a good production compromise for both mitigating the meniscus problem and providing good string contact registration. Another advantage of the narrow pad is that it provides maximum incremental resistance change (delta R) for any given string deviation along the fret axis.

The length of the resistive pads 134, 146, 148 is made as long as possible while providing a gap of 0.010 inch between adjacent pads. Due to the normal lengthwise tapering of the guitar neck, the frets may be made in four graduated lengths. On the longest of such graduated frets, the length of the resistive pads would be about 0.275 inch. The width or thickness of the fret body 126 i.e. the dimension in the same direction as the guitar strings) is 0.1 inch.

FIG. 15 illustrates diagrammatically a fragment of the neck 34 of the guitar and an end portion of a fret 123 of FIG. 10 inserted in one of the slots 121 therein. Adjacent the bottom of the slot 121 are on opposite sides two parallel ribs 152, 154 which extend for the length of the slot 121. The fret 123 is a sliding fit in the slot 121 with the ribs 152, 154 engaging in the grooves 130, 132 as a tight sliding fit therein. This engagement of the ribs 152, 154 in the grooves 130, 132 firmly retains the fret 123 in position in the guitar neck 34. As illustrated, the lower end of the nearest conductive path 138 is enlarged and engages an electrical contact at the upper end of an upright conductive post 156 which is mounted on a printed circuit board 158. The other resistive pads 134 of the fret are similarly connected through their conductive paths with other contact posts on the printed circuit board 158. The printed circuit board 158 could have a separate longitudinal surface conductor for each of the contact post 156 for all of the resistive pads 134 of all twenty-four frets, these surface conductive paths extending along the underside of the printed circuit board 158 to the body of the guitar. However, preferably, the six contact posts 156 for each fret are connected together via six diodes, mounted on the printed circuit board 158, to a single conductive surface path on the printed circuit board for each fret; with this preferred arrangement there would then only be twenty-four longitudinal conductive paths on the circuit board 158 for all twenty-four frets. As will be appreciated, the contact posts 156 are so positioned and biased that when the fret is fully slid into its respective slot 121, a set of six contact posts register with, and press against, the lower ends of the six conductive paths 138 of the fret.

As can be appreciated from FIG. 15, the lower longitudinal edges of the resistive pad are spaced above the surface of the finger plate of the guitar neck. This provides an important advantage. Conductive salts, resulting from perspiration from the fingers of the guitarist, tend to accumulate at the junctions between the fret and the finger plate. These salt accumulations can in time cause shorting of the frets or portions thereof. By spacing the lower longitudinal edges of the resistive pads above these junctions, such shorting or potential for leakage currents is reduced. The narrower the pad, the greater the distance from the finger plate; as will be appreciated the narrow pads 148 of FIG. 14 provide the greatest clearance between the pads and the finger plate with substantial elimination of this problem of salt accumulation.

FIG. 16 is a cross section through the neck of the guitar, similar to the cross section of FIG. 8, but illustrating a modified neck construction and the mounting of the fret 123 of FIG. 10 therein. The modified neck 162 has a body portion molded from carbon fiber and having a large central longitudinal cavity 160 with a smaller longitudinal cavity 162 on each side thereof. This neck construction reduces the weight of the guitar. The printed circuit board 158 of FIG. 15 is disposed in the central cavity 160 along the length thereof and just below the top thereof. The six contact posts 156 for the shown fret 123 extend upwardly from the circuit board 158 through the lower portion of the finger plate 164 into the transverse slot in the finger board 164 in which the fret 123 is mounted. The upper ends of the contact posts 156 engage the lower ends of the conductive paths from the resistive pads 134 similarly as indicated in FIG. 15, but the conductive paths 138 have been omitted from FIG. 16 for clarity. Modified frets 145 and 147 can be mounted in the same way as fret 123.

Figure 17:
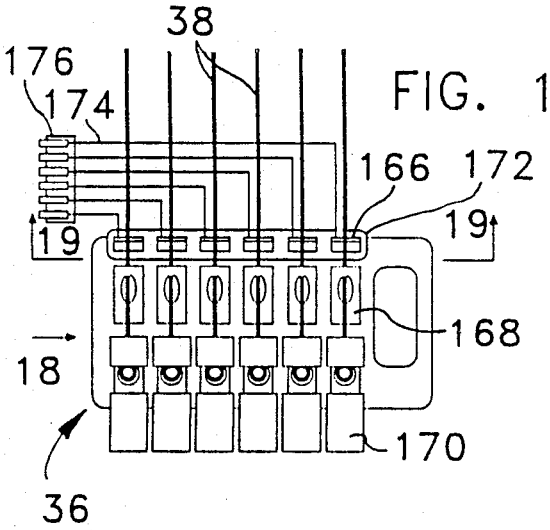
FIG. 17 is a diagrammatic top plan view illustrating further details of the bridge of the guitar of FIG. 1.
Figure 18:
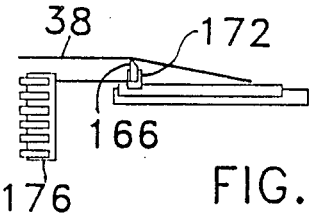
FIG. 18 is a simplified diagrammatic side view of the bridge of FIG. 17 illustrating an electrical connection to one of the strings.
Figure 19:
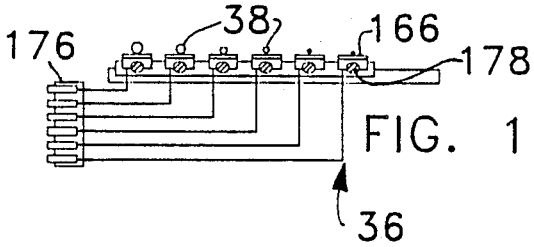
FIG. 19 is a diagrammatic sectional view on the line 19—19 of FIG. 17 illustrating the electrical connections to the six guitar strings.

FIG. 17 is a plan view in more detail of the bridge 36 (see FIG. 1). After leaving the guitar neck and passing over the one or two hex magnetic pickups, the strings 38 pass over and engage in electrical contact with string contacts 166, one for each string. The strings 38 then pass through orifices in insulating guides 168, and the ends of the strings are then anchored in adjustable insulating blocks 171. The blocks 170 are adjustable by screwing in the lengthwise direction of the strings 18 for individually tuning the strings. The string contacts 166 are mounted on an insulating bar 172, and insulated conductor wire 174 connects each string contact 166 to a six pin plug 176. The plug 176 is plugged into a socket inside the guitar body. FIG. 18 diagrammatically shows a simplified side view of the bridge in the direction of the arrow 18 in FIG. 17 illustrating an upper knife-edge portion of the string contact 166 engaged under and supporting the string 138 above the bridge. FIG. 19 is a section on the line 19—19 of FIG. 17 and shows the six strings 38 engaged on the upper knife edges of the string contacts 166 each of which has an adjusting screw 178 for fine adjustment of the knife-edge of each contact 166 relative to its string 38 for intonation adjustment.

FIG. 20 illustrates diagrammatically in a simplified manner the overall electrical system of the musical instrument, and in particular the string/fret intersections and scanning thereof. Four of the twenty-four frets are represented, these being frets 123 as shown in FIG. 10. A partial length of each of the six strings 35 is illustrated traversing the four shown frets 123. Each of the six resistive pads 134 of a respective fret 123 are individually connected via a diode 180 to a conductor 120 extending lengthwise through a channel in the neck of the guitar into the body of the guitar. In the embodiment of FIG. 9 the conductors 120 are the wires 120, whereas in the embodiment of FIG. 16 the conductors 120 are conductive paths on the underside of the printed circuit board 158. The twenty-four conductors 120 (only four of which are shown) terminate in terminals 181 which are sequentially scanned by a scanner 182. The six strings 35, at the bridge end, are similarly connected to six terminals 183 which are scanned by a scanner 184. The scanner 182 scans all twenty-four frets while the scanner 184 stays in communication with one only of the strings. Thus, the string scanner 184 stays on one string terminal 183 while the fret scanner 182 scans all twenty-four fret terminals 181. The string scanner 184 then moves to the next string terminal 183 and again the fret scanner 182 scans all twenty-four fret terminals 181. The outputs from both the fret scanner 182 and the string scanner 184 are fed to the internal computer 46 (see also FIG. 1). When using one hex magnetic pickup 42 (see also FIG. 1) the outputs from the individual magnetic heads are fed via six leads 186 to the internal computer 46. Six taps on the leads 186 are connected via six leads 188 to a summing amplifier 190 the output from which is fed to the circuitry of the audio controls 50 of the guitar (see also FIG. The outputs from the internal computer 46 and the audio controls 50 are fed to the floor unit 54 for data conversion and other functions performed by the floor unit 54 as previously mentioned. An additional computer may be incorporated in the floor unit 54 for performing additional functions, e.g. obtaining compatibility between the audio output (from the hex pickup 42) and the output from the MIDI synthesizer 68. Computed and converted data signals are transmitted from the unit 54 to the MIDI synthesizer 68 (including the rack MIDI function expander 72 shown in FIG. 1). Output from the MIDI synthesizer 68 drives via lead 64 the amplifier 60. The amplifier 60 is also driven via lead 62 by audio signals from the unit 54 (originating from the hex pickup 42). Mains power is supplied via lead 56 to the unit 54 where it is rectified to 5 volts DC which is then supplied throughout the system.

As will be appreciated, when a string 35 is pressed against a resistive element 134 of a fret, the resistance of and the voltage drop in the series circuit between the respective string terminal 183 and fret terminal 181 via the resistive element 134 and its associated diode 180, will depend upon the exact location along the resistive pad 134 at which the string 35 makes electrical contact. Thus, perfect "bending" of a note can be instantaneously obtained by sidewards deflection of the string on the fret while in contact therewith; such "bending" is obtained without any adjustment in style of the guitarist as when bending a note on a conventional non-electric guitar. Preferably, the system incorporates a dead band of reasonably narrow width about the normal position at which a string 35 would contact a resistive pad 134 when playing the true note at that string/-fret intersection; bending would then only start after deviation from this central dead band position.

By continually scanning the six strings, and scanning all twenty-four frets during the scan of each string, a serial data string such as resistive values or voltages and their locations on the neck of the guitar are provided. Thus, any note on the guitar, and its duration of being played, is completely defined. The string scanner 84 operates at 100 kilo Hertz and the fret scanner 182 operates at 2.4 mega Hertz. This serial data string is then converted to MIDI note number data and note on/off data. The hex pickup 42 is primarily used to sense use of the pick by the guitarist's right hand. If desired, this pick data can be used to set the MIDI note on status (which is applied to the waiting note down number for the picked string). Note off is sent when note down is terminated i.e. the string is released. The hex pickup 42 will also send MIDI velocity data. Further, note off data may also be sent when this velocity value drops below a chosen threshold value. In order to minimize MIDI bend data streams and provide more useful data, each resistive pad's resistive value is digitally trimmed to reasonable musical values, and the internal computer 46 computes by sensing the rate at which there is a value change outside of the small dead band that is not half of the next valid semitone (true MIDI note number) and generates a good slew rate by extrapolating the proper fill values to make the bends smooth. It should be noted that in the software associated with use of MIDI, a dead band exists around each MIDI note to absorb drift and garbage. Initial tuning of the guitar/-controller consists of an operator sliding his finger up each string in turn over each fret. The system will read the values so produced, and generate and remember the proper offsets to bring all notes into the proper range. A battery, which may be housed in the guitar, can keep the tuning offsets valid when the instrument is not in use. However, this may preferably be achieved by employing a double EEPROM (electrically erasable programmable read only memory) inside the guitar and associated with the internal computer unit 46.

Figure 21:
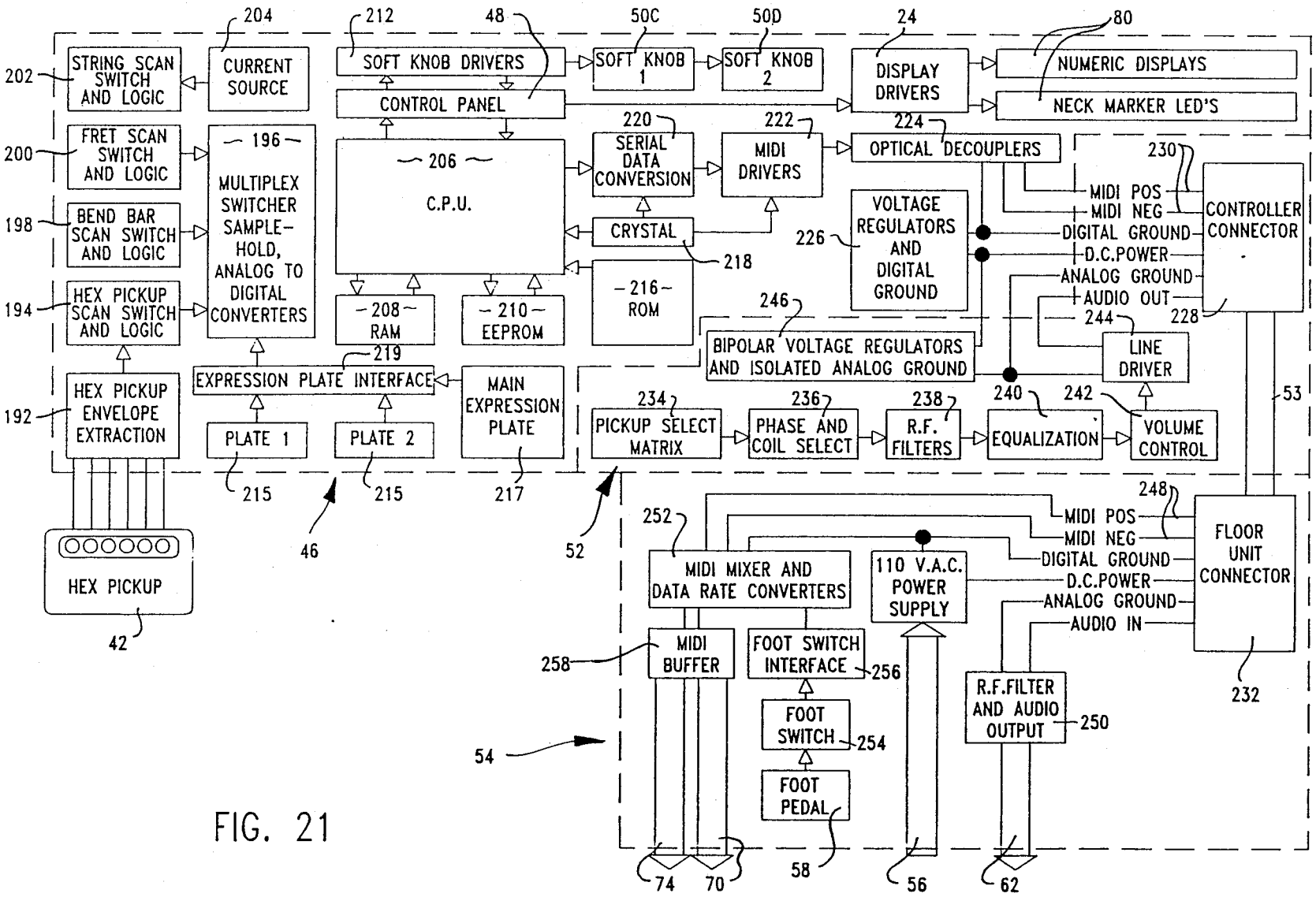
FIG. 21 is a simplified block schematic of the electronics housed in the guitar body of FIG. 1, comprising a computer unit and circuitry associated with the control knobs, and of the electronics of a floor unit connected by a cable thereto.

FIG. 21 is a diagrammatic block schematic of the internal computer unit 46 in the guitar body, the internal audio control unit 52 in the guitar body, the floor digital data conversion unit 54 and the interconnection therebetween.

In the internal computer unit 46, the output from the hex pickup 42 (see FIGS. 1 and 20) is fed to a hex pickup envelope extraction component 192 the output from which is fed to a hex pickup scan switch and logic circuitry 194 which inputs to a multiplex switcher, sample-hold and analog to digital conversion unit 196. A bend bar can switch and logic circuit 198 also inputs to the unit 196 which has a further input from a string scan switch and logic circuit 200. A source of 5 volt DC current is supplied from a rectifier 204 to a string scan switch and logic circuit 202 the output from which feeds into the fret scan switch and logic circuit 200. The output from the multiplex switcher unit 196 feeds into a computer processing unit 206 which has associated with it a RAM (random access memory) 208, a ROM (permanent read only memory) 216, and an EEPROM (electrically erasable programmable read only memory) 210. The output from the computer processing unit 206 is fed to a serial data conversion unit 220 the output from which feeds MIDI drivers 222. A crystal 218 also has outputs that feed to the computer processing unit 206, the serial data conversion unit 220, and the MIDI drivers 222. The MIDI drivers 222 feed optical decouplers 224 which supply MIDI positive signals, MIDI negative signals, and a digital ground to a controller connector 228, in the internal audio control unit 52, via three of six feed lines 230. The digital ground and a DC power line are connected between a voltage regulators and digital ground component 226 and the controller connector 228. The control panel 48 (see also FIG. 1) has input and output connections with the computer processing unit 206, and the functions of the "soft" control knobs 50*c*, 50*d* and their associated soft knob drivers 212 are selectable via the control panel 48. The control panel 48, through display drivers 214, also illuminates neck marker LED's and numeric displays in the visual display 80 on the guitar. Two touch platew 215 on the guitar body, one on either side of the bridge, and providing extra functions such as turning vibrato on and off, and a main expression plate 217 input the multiplex switcher via an expression plate interface 219.

In the audio controller unit 52, bipolar voltage regulators and isolated analog ground circuitry is applied with DC power and an analog ground from the controller connector 228. Audio output from the controller connector 229 is fed via one of the leads 230 to a line driver 244. The input to the line driver 244 comes from the hex pickup 42 via a pickup select matrix 234, a phase and coil select unit 236, radio frequency filters 238, equalization circuitry 240, and volume control circuitry 242.

A floor unit connector 232 in the floor unit 54 is connected via the interface cable 53 with the controller connector 228 in the internal audio control unit 52. The floor unit connector 232 has six leads 248, the upper three being for MIDI positive signals, MIDI signals, and digital ground, respectively, and being connected to MIDI mixer and data rate convertors 252. 110 volt AC power supplied to the floor unit 54 via the mains cable 56 is fed via one of the leads 248 to the floor unit connector 232 as 5 volt DC power. The last two of the leads 248 from the floor unit connector 232 carry an analog ground and audio in-signals to the audio amplifier 60 (see FIG. 20) via a radio frequency filter and audio output circuit 250 and cable 62. The foot pedal 58 operates a foot switch 254 which outputs through a foot switch interface 256 to the MIDI mixer data rate converters 252, the output from the latter being fed to a MIDI buffer 258 and thence via cable 74 to the rack MIDI function expander 72.

By modifying the arrangement in FIGS. 20 and 21 to supply the current to the frets via the conductors 120 and to ground via the strings 35, with reversal of the direction of the diodes 180, and by scanning all six strings while each fret is being scanned, an improved electrical system may be provided. As will be appreciated, the diodes 180 in either arrangement prevent "talking" between the frets, particularly when a string is touching more than one fret. Further, the system is arranged only to react to the fret nearest the bridge when a string is contacting more than one fret.

Figure 22:
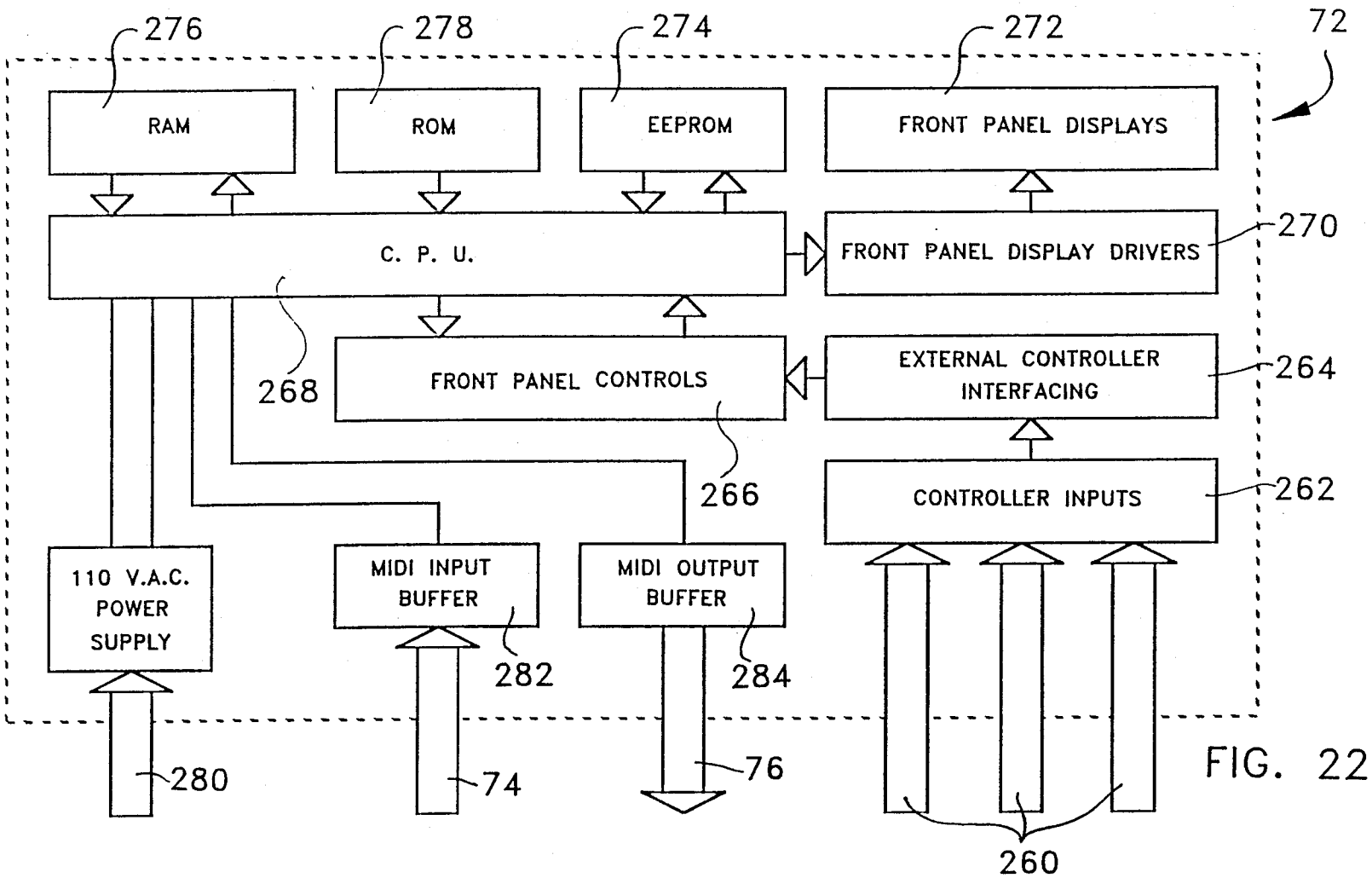
FIG. 22 is a simplified block schematic of a rack MIDI function expander connected in FIG. 1 between the floor unit and a MIDI synthesizer.

FIG. 22 is a simplified diagrammatic block representation of the rack MIDI function expander 72. The unit has its own mains power supply 280 which, after conversion, powers a computer processing unit 268. The computer processing unit has the normally associated RAM, ROM, and EEPROM memories 276, 278 and 274 respectively. The unit 72 has front panel displays 272 which are illuminated via front display drivers 270 controlled from the computer processing unit 268. The main input data for the computer processing unit 268 comes from the cable 74 (connected to the MIDI buffer 258 of the floor unit 54) via a MIDI input buffer 282. The main output from the computer control unit 268 is fed via a MIDI output buffer 284 and the cable 76 to the MIDI synthesizer 68 (see FIGS. 1 and 20). Various other controller inputs 260 influence the functioning of the computer processing unit 268 via an external controller interfacing unit 264 and front panel controls 266 on the unit 72.

It will be appreciated that all the units, components and circuitry represented by the various blocks in FIGS. 21 and 22 are individually well known in the MIDI synthesizer and electrical musical art. In general, the manner of interconnecting, setting and programming these various items is well known in this art and does not require further description.

It will be appreciated from the foregoing description that the guitar 30 can be operated in the complete musical instrument system as a MIDI guitar controller for MIDI synthesization, or as an audio electric guitar using one or two hex pickups, or simultaneously as a MIDI guitar controller and an audio guitar. The fret and scanning arrangements of the invention enable any note to be naturally "bent", and one hex pickup can function through the internal computer and the digital data conversion unit to enable full right hand pick expression to be obtained.

Different brands and different weights of strings have different non-linearities. Further, as guitar strings age, the degree of pitch change obtained during bending starts to change. Consequently, with aged guitar strings, and the above system being used to simultaneously produce direct audio sound and MIDI synthesized sound, there could be a slight discrepancy on the pitch change while bending a note. This can be rectified by having the internal computer 46 (or a computer in the floor unit 54) recognize the zero crossings from the audio pitch (via the hex pickup 42) of the note being bent, and use this as an input to readjust the true MIDI value being generated for the bent note. In other words, the true MIDI value for the perfect bending of the note is adjusted to be off so as to coincide with the pitch of the direct audio output of the note being bent from the old string. Using pitch to effect in this way minor adjustments in the values present from the resistive frets will be immune to detection lag and instability.

As will be appreciated by those skilled in the art, the electric guitar/controller system of the present invention provides an extremely versatile musical instrument with a high degree of potential for obtaining different sound effects by inputing various software into the internal computer unit 46 and/or into a further computer unit incorporated in the floor unit 54. Further, this versatility is obtained without requiring a new or special playing technique for the guitar; the guitar/controller can be played in traditional conventional guitar style and will automatically respond by giving all the individual expression requested of it by the guitarist.

In particular, the system provides for bending notes, avoids pitch instabilities, eliminates any lag time, and eliminates any note on/note off confusion. Further, the length of time a note can be held on is not limited to the time the string can vibrate. A choice of left hand only, right hand only, and normal playing styles are accommodated. Also, if desired, left hand and right hand playing can be sent to different synthesizers via the rack MIDI function expander.

The above described embodiments, of course, are not to be construed as limiting the breadth of the present invention. Modifications, and other alternative constructions, will be apparent which are within the spirit and scope of the invention as defined in the appended claims.

What is claimed is:

1. An electric guitar, comprising:

a body structure carrying fret assemblies and strings extending lengthwise over the fret assemblies;

each fret assembly including means, comprising at least one resistive element forming part of that fret assembly and being associated with a string contact surface of that fret assembly, for enabling the effective resistance of said element to change in dependence upon transverse deflection of a string when in contact with said surface for enabling note bending to be achieved; and each said fret assembly having a lengthwise direction extending transversely to said strings, and said resistive element extending the length of its respective fret assembly in the lengthwise direction of that fret assembly.

2. An electric guitar, comprising:

a body structure carrying fret assemblies and strings extending lengthwise over the fret assemblies;

each fret assembly including means, comprising at least one resistive element forming part of that fret assembly and being associated with a string contact surface of that fret assembly, for enabling the effective resistance of said element to change in dependence upon transverse deflection of a string when in contact with said surface for enabling note bending to be achieved; and said resistive element comprising a resistive pad forming at least part of said string contact surface of that respective fret assembly.

3. The electric guitar of claim 2, wherein said pad comprises baked resistive cermet ink.

4. An electric musical instrument, comprising:

a body structure carrying a plurality of discrete fret assemblies and at least one string extending over the fret assemblies;

said fret assemblies being elongate and extending in lengthwise direction transversely to said string, and said fret assemblies being physically spaced apart along said string;

each fret assembly including its own separate resistor contactable by the string when brought into contact with the respective fret assembly;

means for completing an electric circuit comprising at least portions of said string and the respective resistor when the latter is contacted by said strings the resistance of the respective resistor in said circuit varying in dependence on the location on the respective resistor at which said string contacts that resistor; and means, associated with said electric circuit completing means, for determining the note being played, and for enabling bending of that note responsive to changes in said resistance of the respective resistor, contact between the string and a respective fret assembly establishing the note being played and transverse deflection of the string on this fret assembly in the lengthwise direction of the latter effecting bending of this note.

5. The electric musical instrument of claim 4, wherein each said resistor forms an upper surface of the respective fret assembly below said string.

6. The electric musical instrument of claim 5, wherein each said resistor comprises a resistive pad.

7. The electric musical instrument of claim 6, wherein said pad is formed by a coating on a body member of the fret assembly, said coating having a discrete thickness.

8. The electric musical instrument of claim 4, wherein each said resistor is elongate and extends lengthwise in the lengthwise direction of the respective fret assembly.

9. The electric musical instrument of claim 8, wherein each said resistor comprises a resistive pad which forms a string contact surface of the respective fret assembly.

10. An electric musical instrument, comprising:

a body structure;

at least one electrically conductive string connected to said body structure;

a plurality of frets supported by said body structure, said string extending over said frets;

each fret having a surface contactable by said string when depressed thereagainst, said surface protruding above a surrounding surface area of said body structure, at least a portion of said protruding fret surface being formed by a resistive element;

means for completing an electric circuit through said string and any said fret when said string is brought into contact with the resistive element of the respective fret, and for determining a musical note to be played by such contact;

the electrical resistance of the resistive element in said circuit varying in accordance with transverse deflection of said string on and in contact with the resistive element; and means responsive to said varying of said electrical resistance, for causing variation in a parameter of the musical note being played on the musical instrument.

11. The electric musical instrument of claim 10, wherein each said resistive element comprises an electrically resistive pad.

12. The electric musical instrument of claim 11, wherein said pad has a discrete thickness.

13. The electric musical instrument of claim 12, wherein said thickness is 0.0005 inch.

14. The electric musical instrument of claim 10, wherein said parameter is pitch of the note being played and transverse deflection of said string while in contact with said resistive element effects bending of the note being played.

15. An electric guitar, comprising;

a body structure carrying a plurality of spaced apart frets;

at least one string carried by the body structure and extending in a lengthwise direction over and out of contact with the frets;

the frets extending parallel to each other in a direction transverse to the lengthwise direction of the string;

each fret having a string contact surface which is contacted by the string when depressed against the respective fret to determine the musical note to be played;

each said contact surface being formed by a resistive element which extends in said direction transverse to the lengthwise direction of the string;

means for completing an electric circuit through at least portions of the string and the respective resistive element of one of the frets when the string is depressed thereagainst, the effective resistance of the respective resistive element in said electric circuit changing in dependence upon transverse deflection of the string when in contact with the respective resistive element for enabling note bending to be achieved.

16. The electric guitar of claim 15, having a plurality of strings extending over said frets.

17. The electric guitar of claim 16, wherein the respective contact surface of each fret comprises a plurality of spaced apart resistive elements, each respective resistive element being for contact by a respective one of said strings.

* * * * *